US008203063B2

(12) United States Patent
Truda

(10) Patent No.: US 8,203,063 B2
(45) Date of Patent: Jun. 19, 2012

(54) PORTABLE TUNING APPARATUS

(76) Inventor: Jason Michael Truda, Glen Allen, VA (US)

( * ) Notice: Subject to any disclaimer, the term of this patent is extended or adjusted under 35 U.S.C. 154(b) by 0 days.

(21) Appl. No.: 13/187,697

(22) Filed: Jul. 21, 2011

(65) Prior Publication Data

US 2012/0017745 A1 Jan. 26, 2012

Related U.S. Application Data

(60) Provisional application No. 61/366,938, filed on Jul. 23, 2010.

(51) Int. Cl.
*G10D 13/02* (2006.01)

(52) U.S. Cl. ..... 84/411 R

(58) Field of Classification Search ..... 84/312 R, 84/411 R, 411 A, 421, 411 P
See application file for complete search history.

(56) References Cited

U.S. PATENT DOCUMENTS

2009/0064844 A1* 3/2009 O'Connor ..... 84/411 R
* cited by examiner

*Primary Examiner* — Kimberly Lockett
(74) *Attorney, Agent, or Firm* — Ash Tankha; Lipton, Weinberger & Husick

(57) ABSTRACT

A portable tuning apparatus comprising keys and a rotatable tuning plate is provided. Each key comprises two opposing connector arms separated by a cranked section and extending perpendicularly from opposing ends of the cranked section. A first opposing connector arm of each key is configured to engageably rotate a lug of multiple lugs that support a drumhead of a percussion instrument. A second opposing connector arm of each key slidably engages with one of the openings arranged at predetermined locations on the rotatable tuning plate. Rotating the rotatable tuning plate causes the second opposing connector arm along with the cranked section of each key to orbitally revolve about the first opposing connector arm of each key. This orbital revolution causes an axial rotation of the first opposing connector arm of each key engaged on the lug and imparts a uniform tension to the lugs for tensioning and tuning the drumhead.

17 Claims, 13 Drawing Sheets

PORTABLE TUNING APPARATUS

CROSS REFERENCE TO RELATED APPLICATIONS

This application claims the benefit of provisional patent application No. 61/366,938 titled "Portable Tuning Apparatus", filed on Jul. 23, 2010 in the United States Patent and Trademark Office.

The specification of the above referenced application is incorporated herein by reference in its entirety.

BACKGROUND

Musical instruments, for example, percussion instruments such as drums typically go out of pitch or out of tune from use over a prolonged period of time and hence need to be tuned, for example, to reach a particular pitch. A drumhead of a drum generally includes a drum skin held in contact within a circular rim of the drum. The tension on the drumhead is adjusted to fine tune the pitch of the drum. Typically, adjusting the tension on the drumhead entails either tightening or loosening multiple lugs located on an exterior body of the drum. It is often necessary to tune each of the lugs uniformly, since tightening or loosening of even a single lug will affect the tension on the drumhead and therefore affect consistency of sound throughout the drumhead. A musician, for example, a drummer may adjust the tension in the drumhead of the drum by manually tuning each lug individually using a key. Tuning each lug individually using a key is laborious, time consuming and may result in tuning each lug on the drumhead inconsistently and non-uniformly, thereby resulting in a variation of the quality of sound output produced by the drum. Moreover, even though tuning keys are manufactured to have the same size and shape by all the manufacturers, these tuning keys generally need to be used individually to tune each lug, which is time consuming and laborious.

Hence, there is a long felt but unresolved need for a portable tuning apparatus that simultaneously and uniformly tunes all the lugs that support a drumhead of a percussion instrument to uniformly adjust the tension in the drumhead to produce an optimum pitch and quality of sound in the percussion instrument. Furthermore, there is a need for a portable tuning apparatus that enables tensioning and tuning of drumheads of different diameters and sizes.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The portable tuning apparatus disclosed herein addresses the above stated needs for simultaneously and uniformly tuning all the lugs that support a drumhead of a percussion instrument to uniformly adjust the tension in the drumhead to produce an optimum pitch and quality of sound in the percussion instrument. The portable tuning apparatus disclosed herein enables tensioning and tuning of drumheads of different diameters and sizes.

The portable tuning apparatus disclosed herein comprises multiple keys and a rotatable tuning plate. Each of the keys comprises a pair of opposing connector arms separated by a cranked section. The opposing connector arms extend perpendicularly from opposing ends of the cranked section. In an embodiment, a first opposing connector arm of each of the keys is substantially parallel to a second opposing connector arm of each of the keys. The first opposing connector arm of each of the keys is configured to engageably rotate a lug of multiple lugs that support the drumhead of the percussion instrument. The second opposing connector arm of each of the keys is configured to slidably engage with one of multiple openings on the rotatable tuning plate.

The rotatable tuning plate comprises multiple openings arranged at predetermined locations on the rotatable tuning plate. The locations of the openings of the rotatable tuning plate are predetermined based on standard sizes of the drumhead of the percussion instrument. In an embodiment, the openings of the rotatable tuning plate are concentrically arranged about a center point of the rotatable tuning plate at predetermined locations on the rotatable tuning plate to align with the lugs that support the drumhead having any one of multiple diameters. The openings of the rotatable tuning plate are configured to accommodate the second opposing connector arm of each of the keys of multiple sizes. The second opposing connector arm of each of the keys is configured to snap into one of the openings of the rotatable tuning plate.

In an embodiment, the portable tuning apparatus disclosed herein further comprises a handle rigidly connected to the rotatable tuning plate for gripping by a user to rotate the rotatable tuning plate in a clockwise direction or a counterclockwise direction. A rotation of the rotatable tuning plate causes the second opposing connector arm of each key slidably engaged with one of the openings on the rotatable tuning plate, along with the cranked section of each key to orbitally revolve about the first opposing connector arm of each key. The orbital revolution of the second opposing connector arm along with the cranked section of each key causes an axial rotation of the first opposing connector arm of each key engaged on one of the lugs that support the drumhead. The axial rotation of the first opposing connector arm of each key simultaneously rotates the engaged lugs that support the drumhead of the percussion instrument and imparts a desired uniform tension to the lugs for tensioning and tuning the drumhead of the percussion instrument. The axial rotation of the first opposing connector arm of each key engaged on the lug uniformly varies tension of the lugs that support the drumhead of the percussion instrument for tensioning and tuning the drumhead of the percussion instrument.

The portable tuning apparatus disclosed herein is configured to tension and tune drumheads having one of multiple diameters. In an embodiment, a tension measuring and setting device is operably connected to each of the lugs that support the drumhead to control and adjust the tension imparted to each of the lugs for tensioning and tuning the drumhead of the percussion instrument. In another embodiment, a measuring device is operably connected to the drumhead of the percussion instrument or to one or more of the lugs that support the drumhead for measuring the tympanic pressure of the drumhead to adjust the tension of the drumhead.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and instrumentalities disclosed herein.

DETAILED DESCRIPTION OF THE INVENTION

Figure 1:
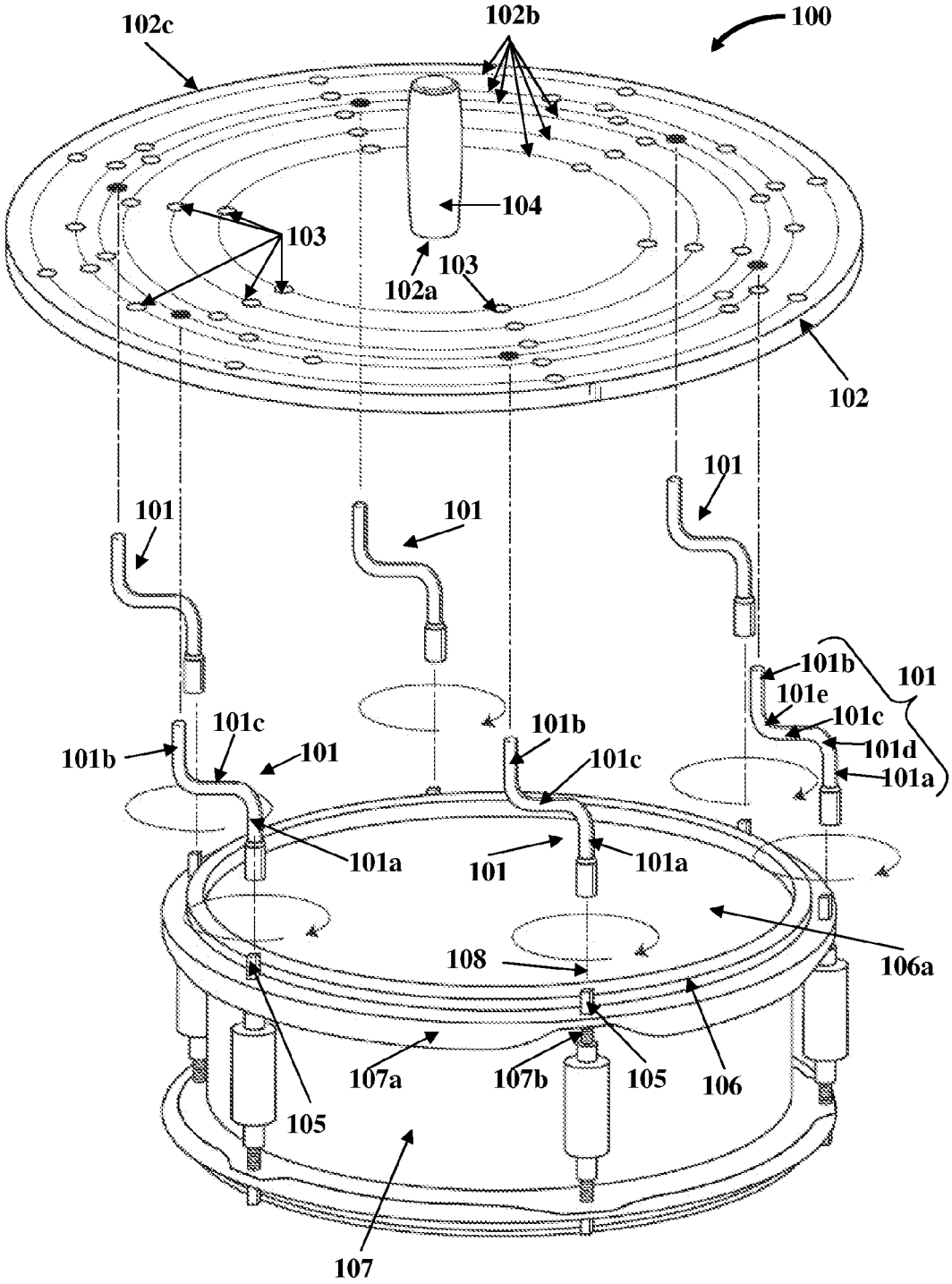
FIG. 1 exemplarily illustrates a top perspective view of a portable tuning apparatus for tensioning and tuning a drumhead of a percussion instrument.

FIG. 1 exemplarily illustrates a top perspective view of a portable tuning apparatus 100 for tensioning and tuning a drumhead 106 of a percussion instrument 107, for example, a drum. The drumhead 106 of the percussion instrument 107 generally comprises a drum skin 106*a* held in contact within a circular rim 107*a* of the percussion instrument 107. The drumhead 106 of the percussion instrument 107 is circumferentially supported by multiple lugs 105 equidistantly positioned on the circular rim 107*a* of the percussion instrument 107. The lugs 105 are connected to tension rods 107*b* positioned around the body of the percussion instrument 107. The lugs 105 in conjunction with the tension rods 107*b* tension the drumhead 106 in relation to the body of the percussion instrument 107.

The portable tuning apparatus 100 disclosed herein comprises multiple keys 101 and a rotatable tuning plate 102. Each of the keys 101 comprises a pair of opposing connector arms 101*a* and 101*b* separated by a cranked section 101*c*. Each of the keys 101 is configured, for example, in the form of a "Z" shape. The opposing connector arms 101*a* and 101*b* extend perpendicularly from opposing ends 101*d* and 101*e* of the cranked section 101*c*. A first opposing connector arm 101*a* of each of the keys 101 is substantially parallel to a second opposing connector arm 101*b* of each of the keys 101. The cranked section 101*c* of each of the keys 101 provides an offset between the first opposing connector arm 101*a* and the second opposing connector arm 101*b*. The first opposing connector arm 101*a* of each of the keys 101 is configured to engageably rotate a lug 105 about an axis 108. The second opposing connector arm 101*b* of each of the keys 101 is configured to slidably engage with one of the openings 103 on the rotatable tuning plate 102.

The rotatable tuning plate 102 is, for example, of a generally circular shape. The rotatable tuning plate 102 comprises multiple openings 103 arranged at predetermined locations on the rotatable tuning plate 102. The openings 103 of the rotatable tuning plate 102 are configured to accommodate keys 101 of multiple sizes. The openings 103 of the rotatable tuning plate 102 are configured to accommodate the second opposing connector arm 101*b* of each of the keys 101 of multiple sizes. The second opposing connector arm 101*b* of each of the keys 101 is configured to snap into one of the openings 103 of the rotatable tuning plate 102. In an embodiment, the openings 103 of the rotatable tuning plate 102 are configured to interchangeably accommodate either the first opposing connector arm 101*a* or the second opposing connector arm 101*b* of each of the keys 101, while the other of the opposing connector arms 101*a* or 101*b* is engaged with a lug 105.

The openings 103 of the rotatable tuning plate 102 are concentrically arranged about a center point 102*a* of the rotatable tuning plate 102 at predetermined locations on the rotatable tuning plate 102 to align with the lugs 105 that circumferentially support the drumhead 106 having any one of multiple diameters. In an embodiment, the openings 103 of the rotatable tuning plate 102 are concentrically arranged about the center point 102*a* of the rotatable tuning plate 102 on concentric circles 102*b* etched on the rotatable tuning plate 102. The etched circles 102*b* are concentric with the center point 102*a* of the rotatable tuning plate 102, for example, at 8 inches, 10 inches, 12 inches, 13 inches, 14 inches, and 16 inches from the center point 102*a* for different sizes of the percussion instrument 107. The periphery 102*c* of the rotatable tuning plate 102 is, for example, at 18 inches from the center point 102*a* of the rotatable tuning plate 102. The locations of the openings 103 of the rotatable tuning plate 102 are predetermined based on standard sizes of drumheads 106. The openings 103 of the rotatable tuning plate 102 are arranged to encompass multiple sizes of percussion instruments 107 with drumheads 106 that require tuning. The openings 103 are drilled into the rotatable tuning plate 102 to line up with the lugs 105 that support drumheads 106 of different diameters. The portable tuning apparatus 100 disclosed herein further comprises a handle 104 rigidly connected to the rotatable tuning plate 102 for gripping by a user, for example, a drummer, to rotate the rotatable tuning plate 102.

Figure 2:
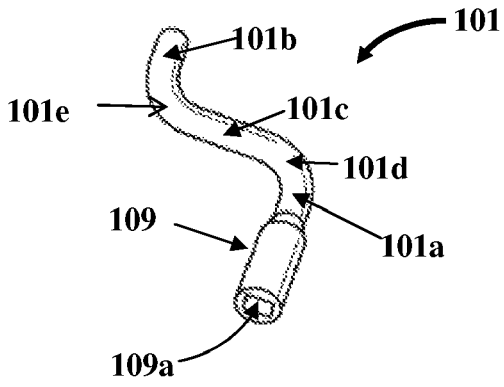
FIG. 2 exemplarily illustrates a perspective view of a key used for tuning a lug of multiple lugs that support a drumhead of a percussion instrument.

FIG. 2 exemplarily illustrates a perspective view of a key 101 used for tuning a lug 105 of multiple lugs 105 that support a drumhead 106 of a percussion instrument 107. The key 101 comprises a pair of opposing connector arms 101*a* and 101*b* separated by a cranked section 101*c*. The first opposing connector arm 101*a* of the key 101 is configured to engageably rotate a lug 105 on the percussion instrument 107 as exemplarily illustrated in FIGS. 4C-4E. The second opposing connector arm 101*b* of the key 101 is configured to slidably engage with one of multiple openings 103 on the rotatable tuning plate 102 as exemplarily illustrated in FIG. 3, FIGS. 4C-4E, and FIG. 5. The opposing connector arms 101*a* and 101*b* of the key 101 extend perpendicularly from the opposing ends 101*d* and 101*e* of the cranked section 101*c*. The cranked section 101*c* of the key 101 is, for example, approximately one inch in length to provide an offset between the first opposing connector arm 101*a* and the second opposing connector arm 101*b*. The cranked section 101*c* of each of the keys 101 is configured to provide an equal offset at all times to allow for rotation of the rotatable tuning plate 102 and thus allow an orbital revolution of the second opposing connector arm 101*b* along with the cranked section 101*c* of each key 101 about the first opposing connector arm 101*a* engaged on the lug 105 when the drumhead 106 is tuned.

In an embodiment, the first opposing connector arm 101*a* comprises a generally cylindrical fastener 109. The cylindrical fastener 109 defines a slot 109*a* shaped to match the shape of each lug 105 that supports the drumhead 106. For example, the slot 109*a* of the cylindrical fastener 109 is square shaped as exemplarily illustrated in FIG. 2, for receiving a square shaped lug 105 as exemplarily illustrated in FIG. 1. The slot 109*a* is configured based on the shape of the lug 105. The slot 109*a* may also be shaped, for example, as a rectangle, a circle, etc., based on the shape of the lug 105.

Figure 3:
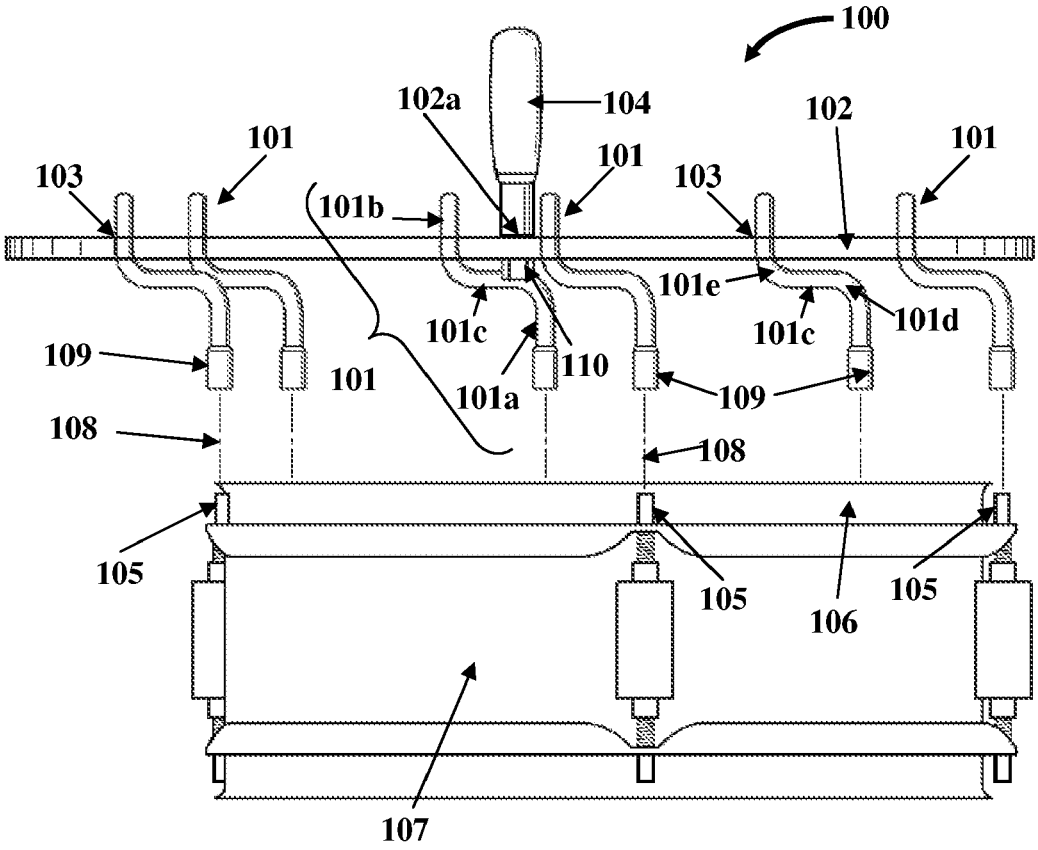
FIG. 3 exemplarily illustrates a front orthogonal view of the portable tuning apparatus prior to engagement of the keys to the lugs that support the drumhead of the percussion instrument.

FIG. 3 exemplarily illustrates a front orthogonal view of the portable tuning apparatus 100 prior to engagement of the keys 101 to the lugs 105 that support the drumhead 106 of the percussion instrument 107. As exemplarily illustrated in FIG. 3, the handle 104 rigidly connected to the rotatable tuning plate 102, for example, by a bolt 110 for providing grip to a user to rotate the rotatable tuning plate 102. The handle 104 enables a user to hold and rotate the rotatable tuning plate 102 for tensioning and tuning the drumhead 106 of the percussion instrument 107 as disclosed in the detailed description of FIGS. 7A-7E. The second opposing connector arms 101*b* of the keys 101 are slidably engaged with the openings 103 on the rotatable tuning plate 102 based on the diameter of the drumhead 106. As exemplarily illustrated in FIG. 3, the first opposing connector arms 101*a* of the keys 101 are coaxially aligned with the lugs 105 that support the drumhead 106 of the percussion instrument 107.

Figure 4A:
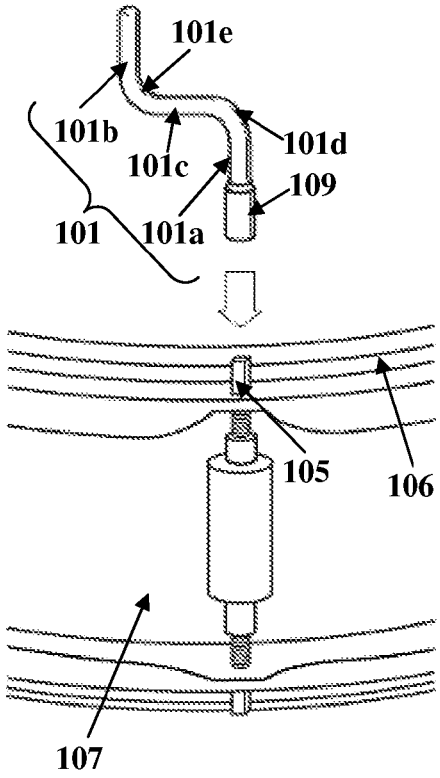
FIGS. 4A-4B exemplarily illustrate front perspective views showing engagement of a key with one of the lugs that support the drumhead of the percussion instrument.
Figure 4B:
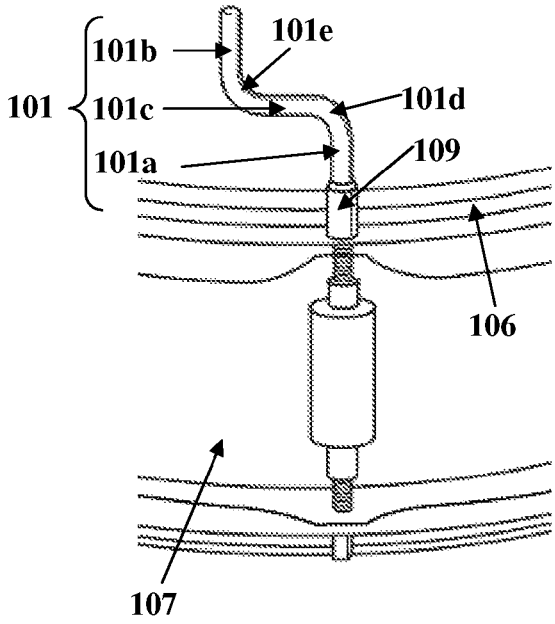

FIGS. 4A-4B exemplarily illustrate front perspective views showing engagement of a key 101 with one of the lugs 105 that support the drumhead 106 of the percussion instrument 107. The first opposing connector arm 101*a* of the key 101 is coaxially aligned with a lug 105 as exemplarily illustrated in FIG. 4A. The generally cylindrical fastener 109 of the first opposing connector arm 101*a* is then engageably connected to the lug 105 as exemplarily illustrated in FIG. 4B.

Figure 4C:
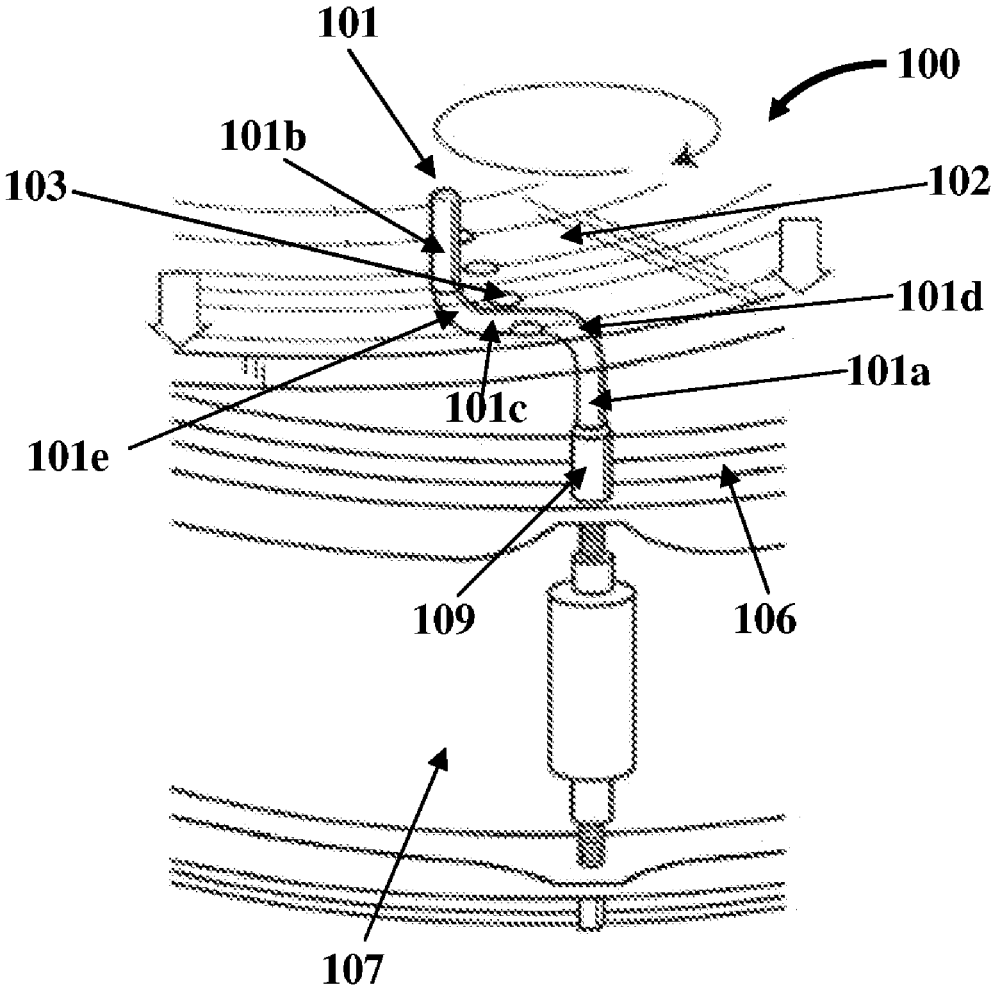
FIGS. 4C-4E exemplarily illustrate front perspective views showing tensioning and tuning of one of the lugs that support the drumhead of the percussion instrument, caused by rotation of a rotatable tuning plate.
Figure 4D:
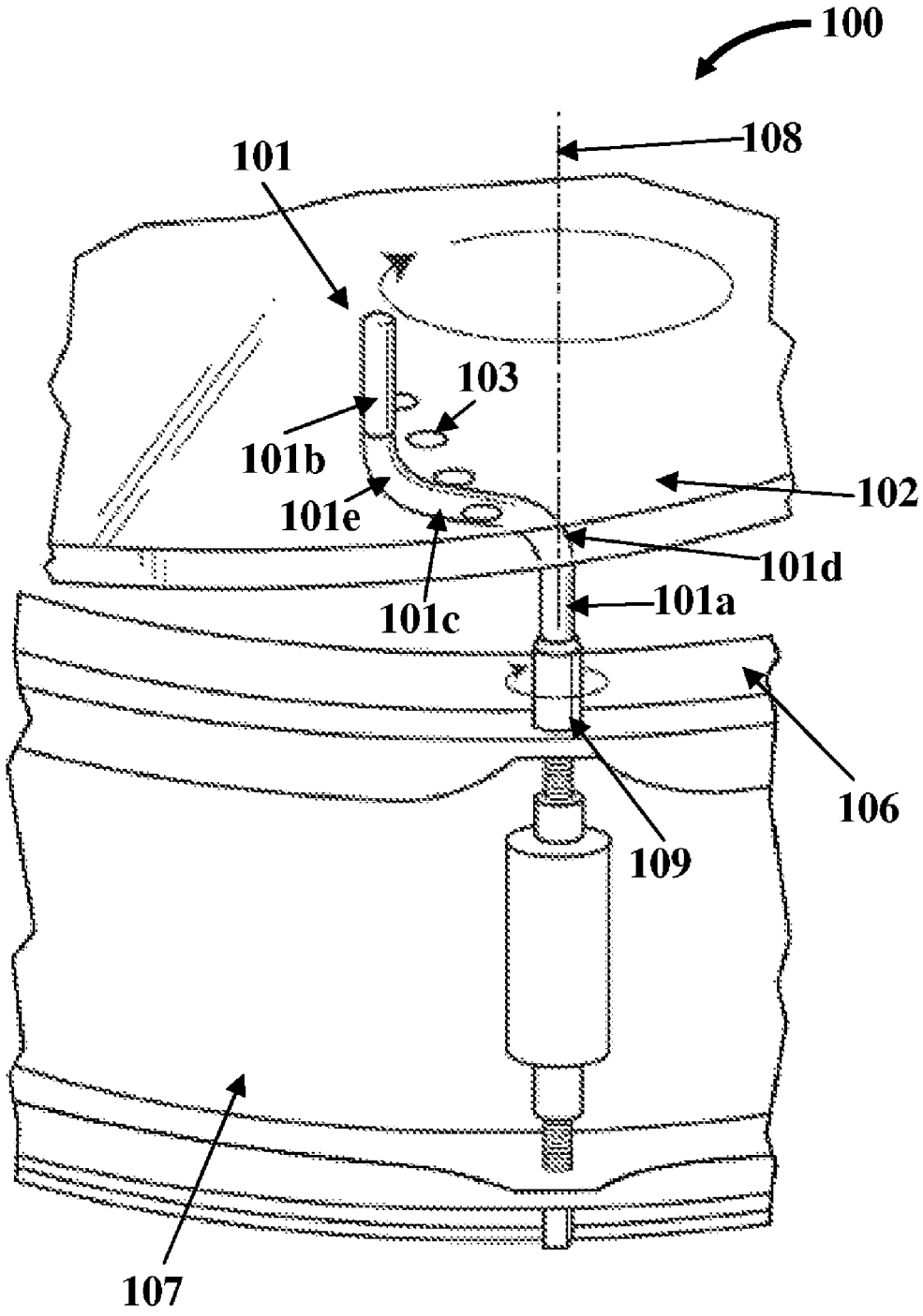
Figure 4E:
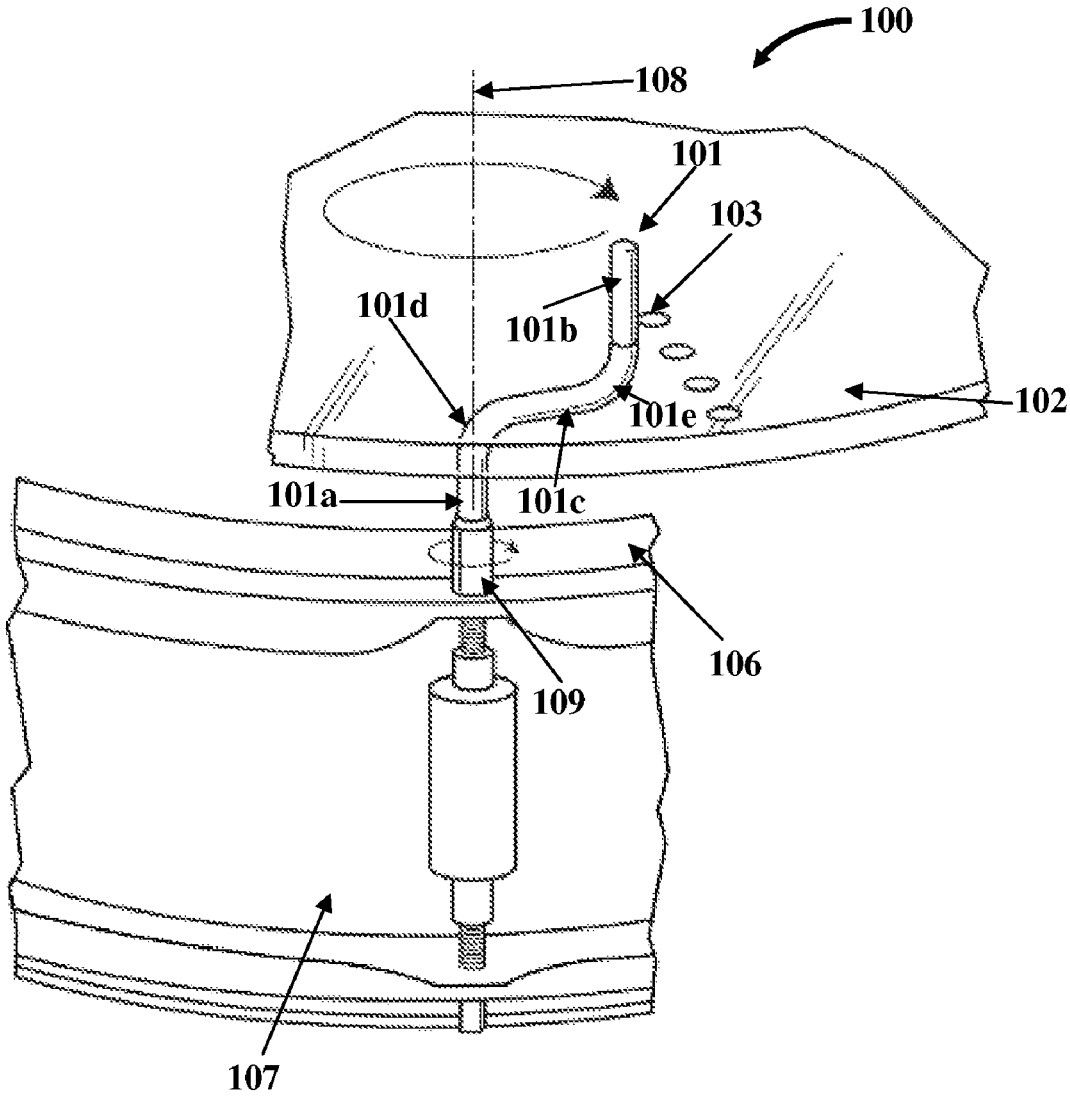

FIGS. 4C-4E exemplarily illustrate front perspective views showing tensioning and tuning of one of the lugs 105 that support the drumhead 106 of the percussion instrument 107 caused by rotation of the rotatable tuning plate 102. The first opposing connector arm 101*a* of the key 101 is coaxially aligned with a lug 105. The second opposing connector arm 101*b* slidably engages with one of the openings 103 on the rotatable tuning plate 102 as exemplarily illustrated in FIG. 4C. A rotation of the rotatable tuning plate 102, for example, in a clockwise direction causes the second opposing connector arm 101*b* along with the cranked section 101*c* of the key 101 to orbitally revolve about the first opposing connector arm 101*a* of the key 101 as exemplarily illustrated in FIGS. 4D-4E. The orbital revolution of the second opposing connector arm 101*b* along with the cranked section 101*c* of the key 101 causes an axial rotation of the first opposing connector arm 101*a* of the key 101 engaged on the lug 105, for example, in a clockwise direction about an axis 108 that passes through the first opposing connector arm 101*a* and the lug 105 as exemplarily illustrated in FIGS. 4D-4E. The axial rotation of the first opposing connector arm 101*a* of the key 101 rotates the engaged lug 105 to tighten or loosen the engaged lug 105. Tightening or loosening of the engaged lugs 105 that support the drumhead 106 of the percussion instrument 107 imparts a desired uniform tension to the engaged lugs 105 for tensioning and tuning the drumhead 106 of the percussion instrument 107.

Figure 5:
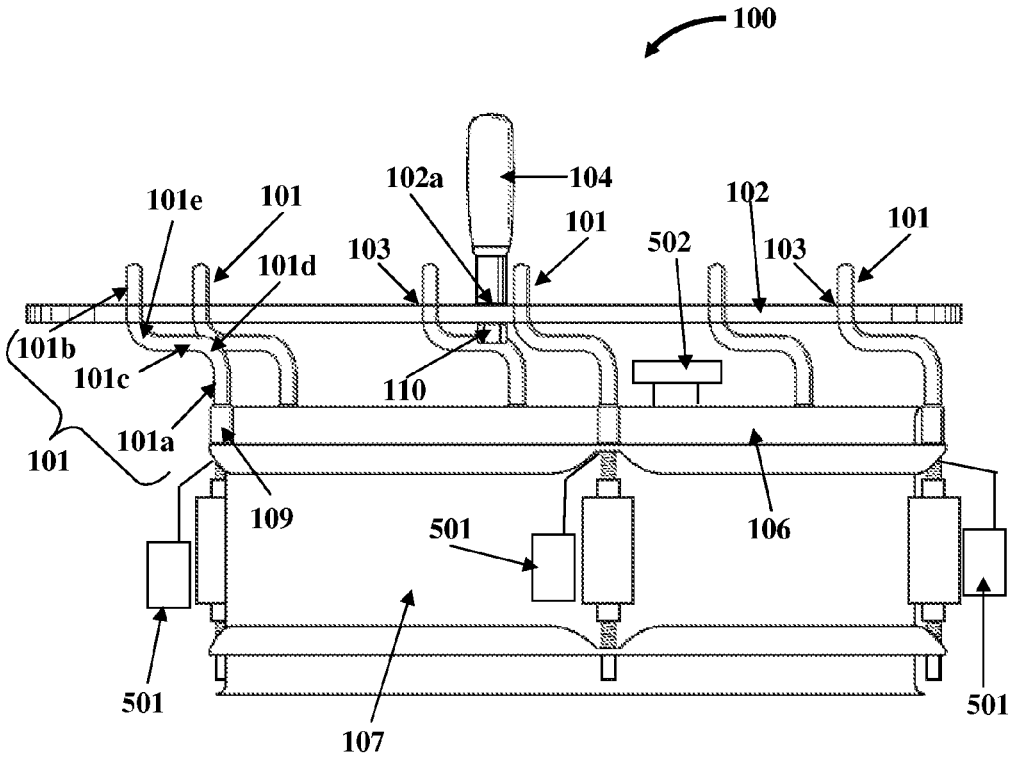
FIG. 5 exemplarily illustrates a front orthogonal view of the portable tuning apparatus after engagement of the keys to the lugs that support the drumhead of the percussion instrument for tensioning and tuning the drumhead.

FIG. 5 exemplarily illustrates a front orthogonal view of the portable tuning apparatus 100 after engagement of the keys 101 to the lugs 105 that support the drumhead 106 of the percussion instrument 107 for tensioning and tuning the drumhead 106. The portable tuning apparatus 100 is positioned for tuning the drumhead 106 of the percussion instrument 107 as exemplarily illustrated in FIG. 5 and as disclosed in the detailed description of FIG. 3 and FIGS. 4A-4E. When the portable tuning apparatus 100 is positioned for tuning the drumhead 106 of the percussion instrument 107, a user, for example, a drummer grips the handle 104 of the rotatable tuning plate 102 and rotates the rotatable tuning plate 102.

A rotation of the rotatable tuning plate 102 causes the second opposing connector arm 101*b* along with the cranked section 101*c* of each key 101 to orbitally revolve about the first opposing connector arm 101*a* as exemplarily illustrated in FIGS. 7A-7E. The orbital revolution of the second opposing connector arm 101*b* along with the cranked section 101*c* of each key 101 causes an axial rotation of the first opposing connector arm 101*a* of each key 101 engaged on the lug 105 as disclosed in the detailed description of FIGS. 4C-4E. The axial rotation of the first opposing connector arm 101*a* of each of the keys 101 rotates an engaged lug 105 to tighten or loosen the engaged lug 105, which imparts a desired uniform tension to the engaged lugs 105 for tuning the drumhead 106 of the percussion instrument 107. The axial rotation of the first opposing connector arm 101*a* of each key 101 engaged on a lug 105 uniformly varies the tension of the engaged lug 105 for tensioning and tuning the drumhead 106 of the percussion instrument 107. In this manner, the lugs 105 that circumferentially support the drumhead 106 are simultaneously tightened or loosened by rotation of the rotatable tuning plate 102, thereby allowing uniform tensioning and tuning of the drumhead 106 of the percussion instrument 107.

In an embodiment as exemplarily illustrated in FIG. 5, a tension measuring and setting device 501 is operably connected to each of the lugs 105 that support the drumhead 106 of the percussion instrument 107 to control and adjust the tension imparted to each of the lugs 105 for tensioning and tuning the drumhead 106. In another embodiment, a measuring device 502 is operably connected to the drumhead 106 or one or more of the lugs 105 that support the drumhead 106 for measuring the tympanic pressure of the drumhead 106 to adjust the tension of the drumhead 106.

Figure 6:
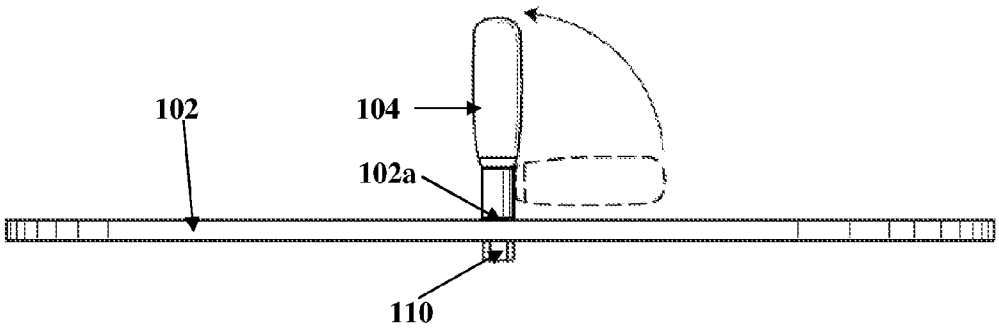
FIG. 6 exemplarily illustrates a front orthogonal view of a rotatable tuning plate of the portable tuning apparatus.
Figure 7A:
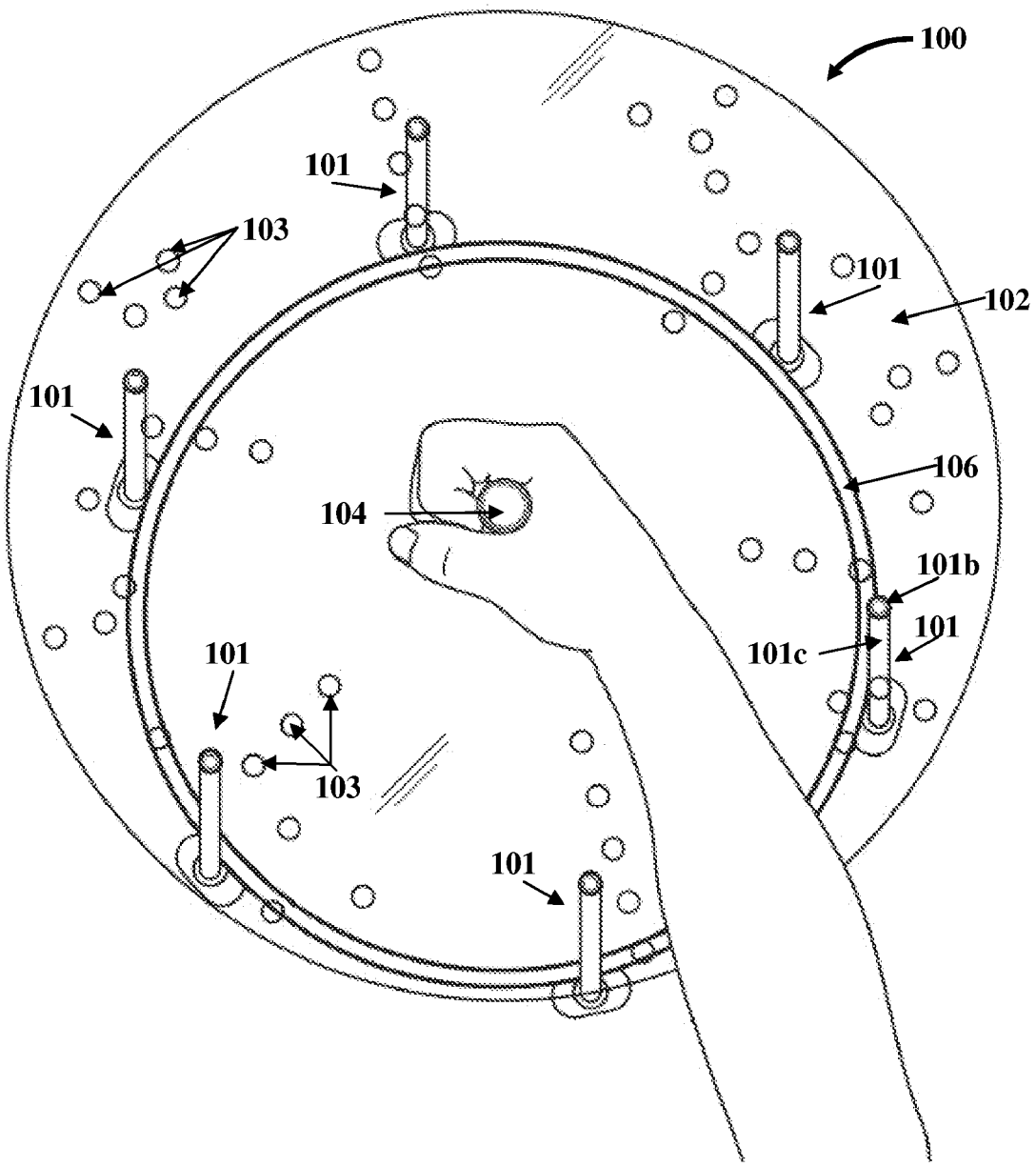
FIGS. 7A-7E exemplarily illustrate top orthogonal views showing tensioning and tuning of a drumhead of a percussion instrument.
Figure 7B:
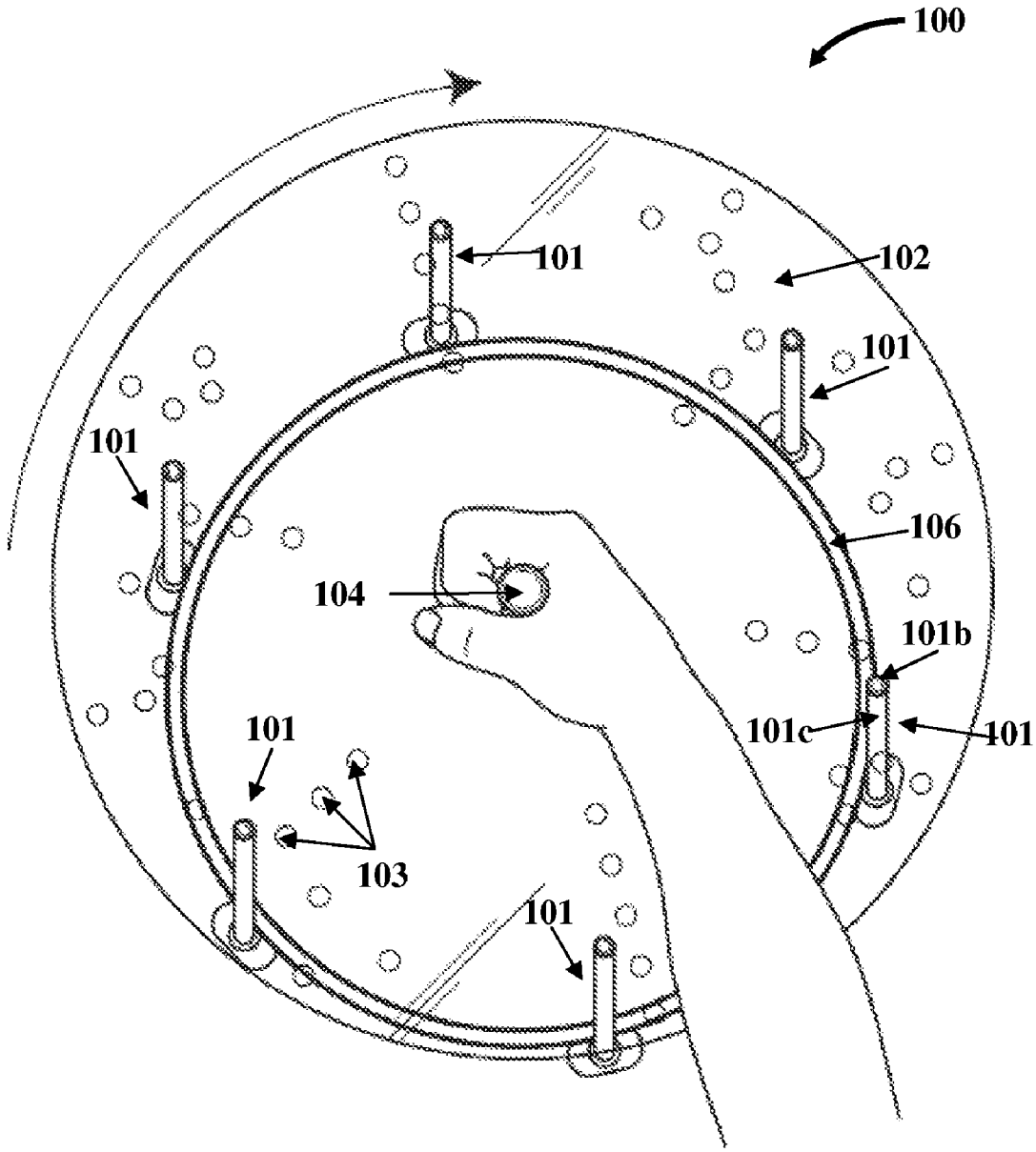
Figure 7C:
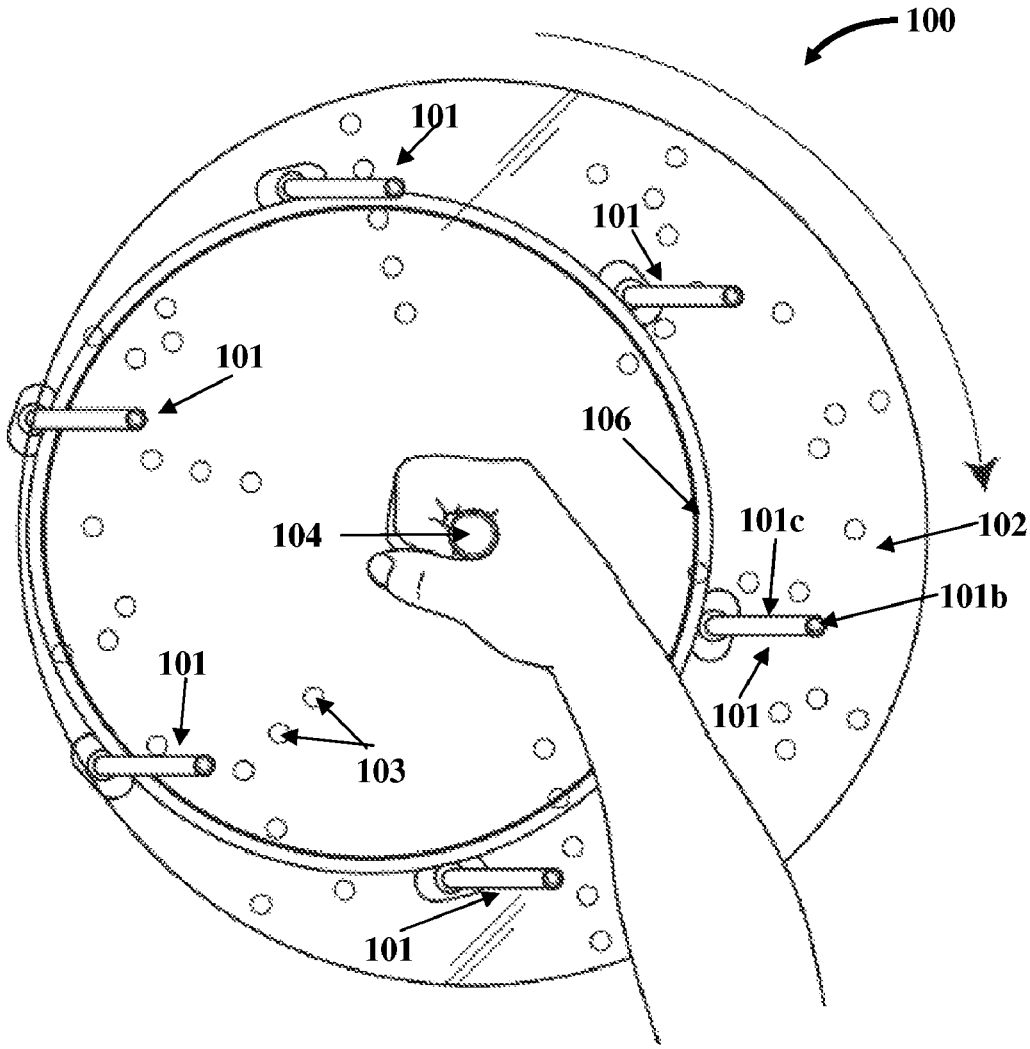
Figure 7D:
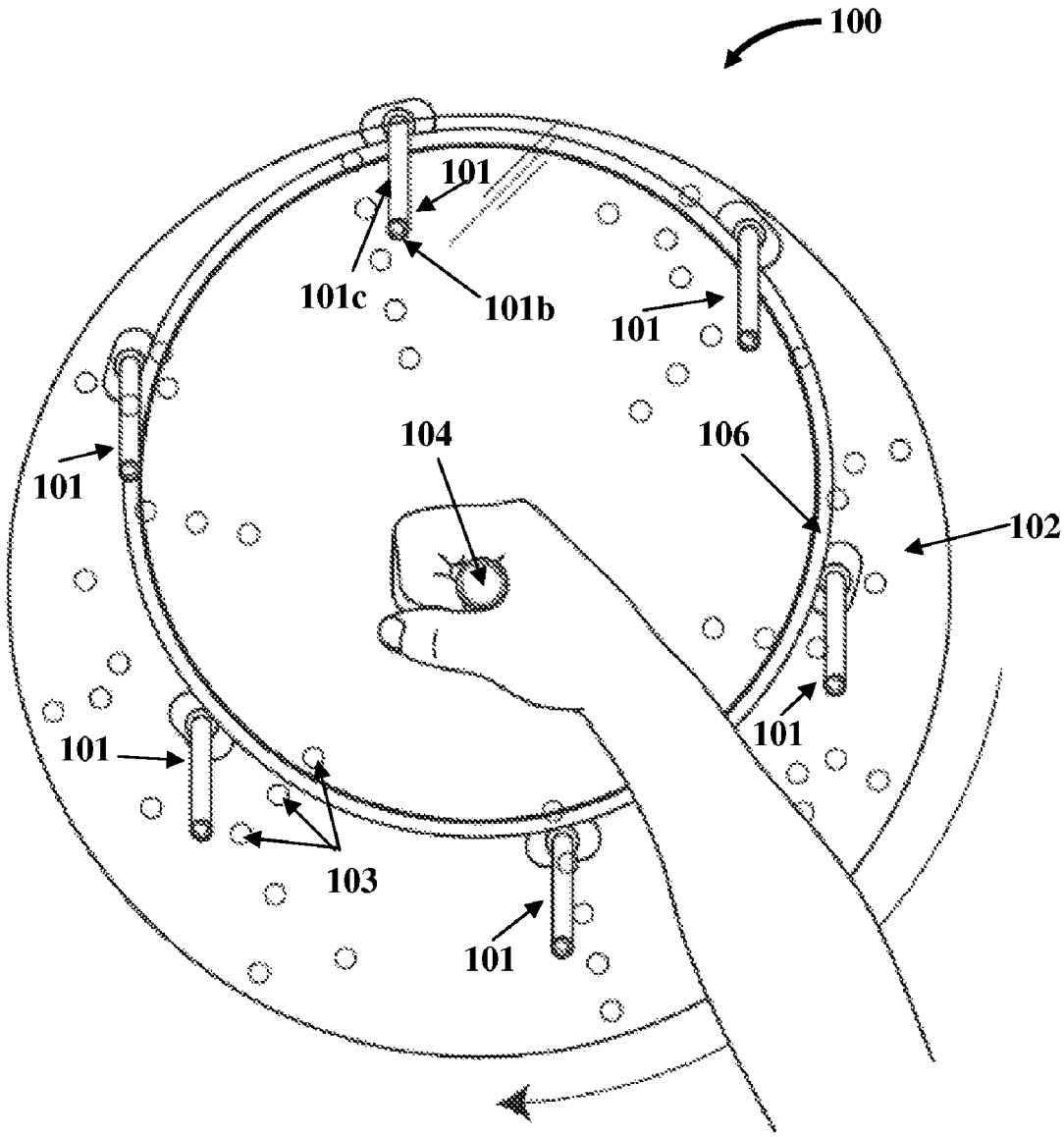
Figure 7E:
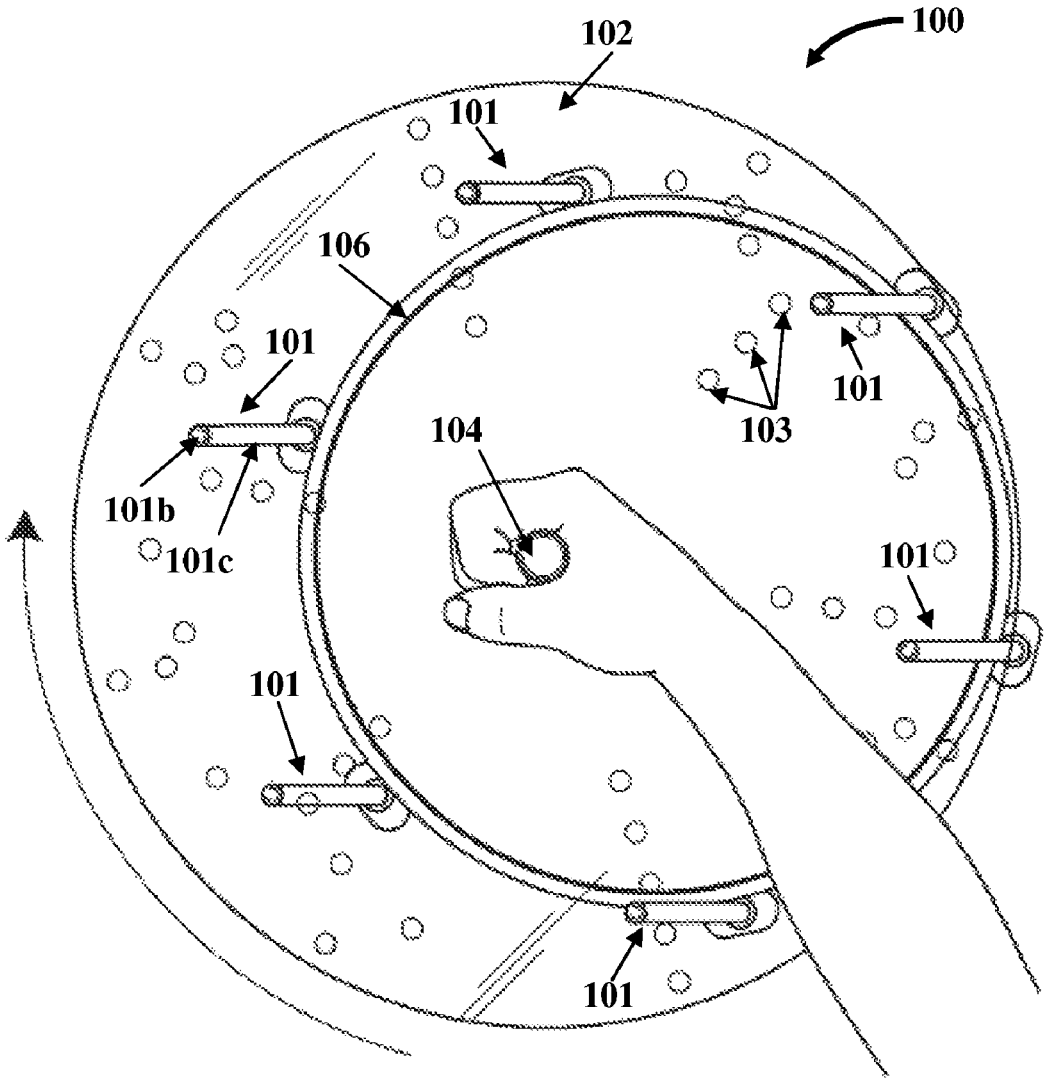

FIG. 6 exemplarily illustrates a front orthogonal view of the rotatable tuning plate 102 of the portable tuning apparatus 100. The handle 104 is rigidly connected to the rotatable tuning plate 102, for example, through the bolt 110. The handle 104 can be swiveled or folded when not in use.

FIGS. 7A-7E exemplarily illustrate top orthogonal views showing tensioning and tuning of a drumhead 106 of a percussion instrument 107. In order to tune the drumhead 106 of the percussion instrument 107, the percussion instrument 107 is first placed, for example, on a level surface. The second opposing connector arms 101*b* of the keys 101 of the portable tuning apparatus 100 are snapped into the openings 103 on the rotatable tuning plate 102 based on the diameter of the drumhead 106. The first opposing connector arms 101*a* of the keys 101 are engaged with the lugs 105 that circumferentially support the drumhead 106 of the percussion instrument 107 as disclosed in the detailed description of FIGS. 4A-4B. A user then grips the handle 104 of the rotatable tuning plate 102 as exemplarily illustrated in FIG. 7A and rotates the rotatable tuning plate 102, for example, in a clockwise direction as exemplarily illustrated in FIGS. 7B-7E. The drumhead 106 of the percussion instrument 107 is tuned by tightening or loosening of the lugs 105 on engageable rotation of the lugs 105 by the keys 101 as disclosed in the detailed description of FIGS. 4C-4E and FIG. 5. The keys 101 simultaneously rotate the engaged lugs 105 on rotation of the rotatable tuning plate 102 and impart a desired uniform tension to the engaged lugs 105 for tensioning and tuning the drumhead 106 of the percussion instrument 107. When the drumhead 106 of the percussion instrument 107 is tuned, the rotatable tuning plate 102 is removed along with the keys 101 from the lugs 105 on the percussion instrument 107.

The rotatable tuning plate 102 may be rotated, for example, to loosen the lugs 105 for removing an existing drumhead 106 or for installing a new drumhead 106. The rotatable tuning plate 102 may be rotated manually, for example, using the handle 104 or electronically.

Figure 8:
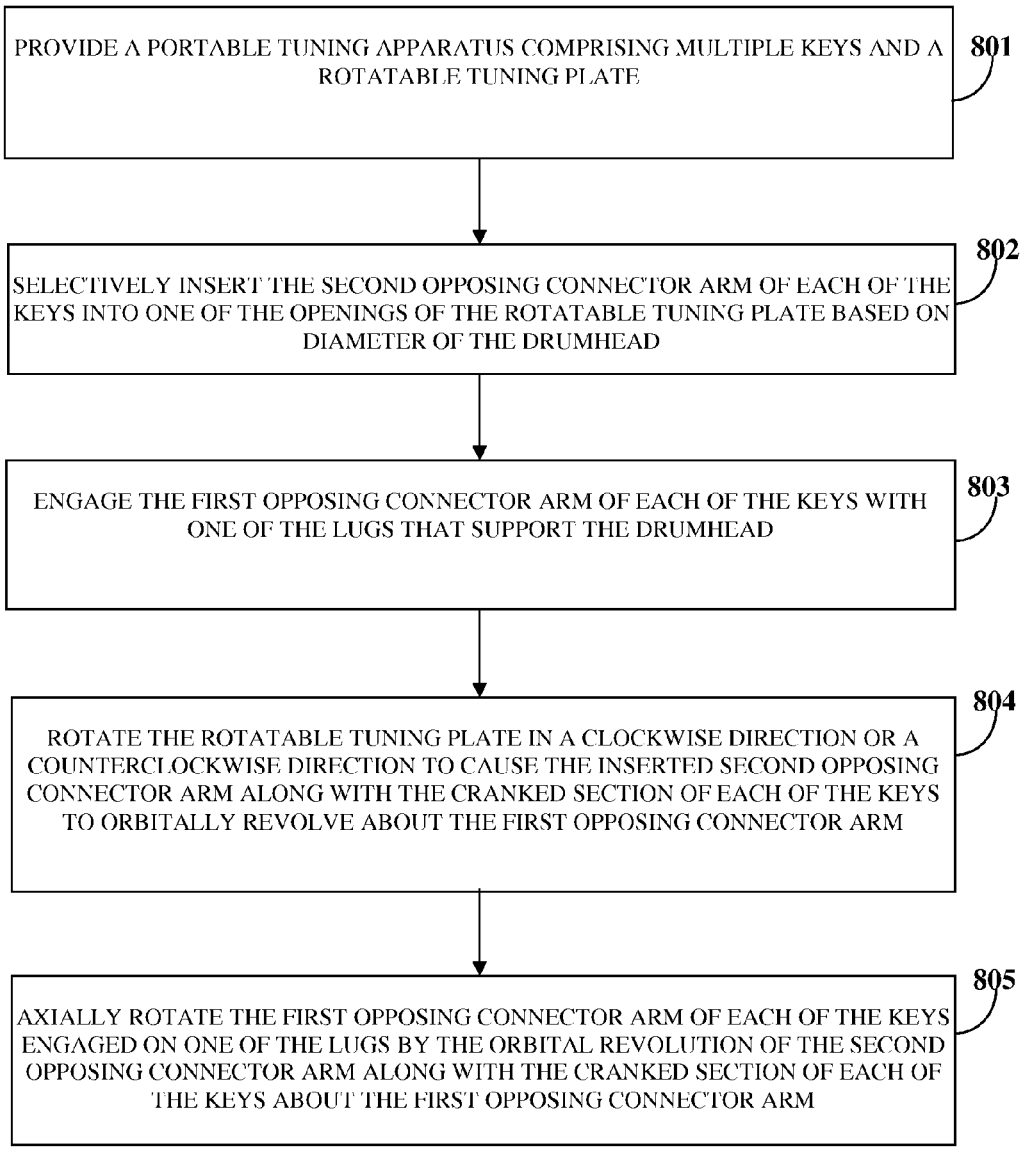
FIG. 8 illustrates a method for tensioning and tuning a drumhead of a percussion instrument.

FIG. 8 illustrates a method for tensioning and tuning a drumhead 106 of a percussion instrument 107. A portable tuning apparatus 100 comprising multiple keys 101 and a rotatable tuning plate 102 as disclosed in the detailed description of FIGS. 1-6 is provided 801. The second opposing connector arm 101*b* of each of the keys 101 is selectively inserted 802 into one of the openings 103 of the rotatable tuning plate 102 based on diameter of the drumhead 106 to be tensioned. The first opposing connector arm 101*a* of each of the keys 101 is coaxially aligned with one of the lugs 105 that support the drumhead 106 as exemplarily illustrated in FIG. 4A. The first opposing connector arm 101*a* of each of the keys 101 is then engaged 803 with one of the lugs 105 that support the drumhead 106 as exemplarily illustrated in FIG. 4B. The rotatable tuning plate 102 is rotated 804 in a clockwise direction or a counterclockwise direction to cause the inserted second opposing connector arm 101*b* along with the cranked section 101*c* of each of the keys 101 to orbitally revolve about the first opposing connector arm 101*a* engaged on one of the lugs 105 as exemplarily illustrated in FIGS. 4C-4E. The orbital revolution of the second opposing connector arm 101*b* along with the cranked section 101*c* of each of the keys 101 causes an axial rotation 805 of the first opposing connector arm 101*a* engaged on one of the lugs 105 as exemplarily illustrated in FIGS. 4D-4E. The axial rotation of the first opposing connector arms 101*a* of the keys 101 rotates the lugs 105 that support the drumhead 106 of the percussion instrument 107 and imparts a uniform tension to the lugs 105 for tensioning and tuning the drumhead 106 of the percussion instrument 107.

The keys 101 simultaneously apply a uniform pressure on the lugs 105 of the drumhead 106 to produce an even tension on the drumhead 106 and allow uniform expansion or retraction of the drumhead 106. After the drumhead 106 is tuned, the user may detach the rotatable tuning plate 102 from the keys 101. Subsequently, the user may detach each of the keys 101 from the respective lugs 105 that support the drumhead 106.

The portable tuning apparatus 100 disclosed herein enables tuning of all the lugs 105 of the drumhead 106 simultaneously by rotation of the rotatable tuning plate 102, thereby reducing time and increasing uniformity and ease of tensioning and tuning the drumhead 106 or changing the drumhead 106. The simultaneous rotation of the lugs 105 of the drumhead 106 by the keys 101 reduces uneven head tension and shell warping. The simultaneous and uniform stretching of the drumhead 106 during tuning also increases the life of the drumhead 106 and increases the sound quality produced by the drumhead 106. The portable tuning apparatus 100 disclosed herein can be used for tuning drumheads 106 of different sizes and brands.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials, and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

I claim:

1. A portable tuning apparatus for tensioning and tuning a drumhead of a percussion instrument, comprising:

a plurality of keys, each of said keys comprising a pair of opposing connector arms separated by a cranked section, wherein said opposing connector arms extend perpendicularly from opposing ends of said cranked section, wherein a first of said opposing connector arms of said each of said keys is configured to engageably rotate a lug of a plurality of lugs that support said drumhead of said percussion instrument, and wherein a second of said opposing connector arms of said each of said keys is configured to slidably engage with one of a plurality of openings on a rotatable tuning plate; and said rotatable tuning plate comprising said openings arranged at predetermined locations on said rotatable tuning plate, wherein a rotation of said rotatable tuning plate causes said second of said opposing connector arms of said each of said keys slidably engaged with said one of said openings on said rotatable tuning plate, along with said cranked section of said each of said keys to orbitally revolve about said first of said opposing connector arms of said each of said keys, wherein said orbital revolution of said second of said opposing connector arms along with said cranked section of said each of said keys causes an axial rotation of said first of said opposing connector arms of said each of said keys engaged on said lug;

whereby said axial rotation of said first of said opposing connector arms of said each of said keys rotates said lug and imparts a uniform tension to said lugs that support said drumhead of said percussion instrument for said tensioning and said tuning of said drumhead of said percussion instrument.

2. The portable tuning apparatus of claim 1, wherein said first of said opposing connector arms of said each of said keys is substantially parallel to said second of said opposing connector arms of said each of said keys.

3. The portable tuning apparatus of claim 1, wherein said openings of said rotatable tuning plate are configured to accommodate said second of said opposing connector arms of said each of said keys of a plurality of sizes.

4. The portable tuning apparatus of claim 1, wherein said openings of said rotatable tuning plate are concentrically arranged about a center point of said rotatable tuning plate at said predetermined locations on said rotatable tuning plate to align with said lugs that support said drumhead having any one of a plurality of diameters.

5. The portable tuning apparatus of claim 1, wherein said locations of said openings of said rotatable tuning plate are predetermined based on standard sizes of said drumhead of said percussion instrument.

6. The portable tuning apparatus of claim 1, wherein said axial rotation of said first of said opposing connector arms of said each of said keys engaged on said lug uniformly varies tension of said lugs for said tensioning and said tuning of said drumhead of said percussion instrument.

7. The portable tuning apparatus of claim 1, wherein said second of said opposing connector arms of said each of said keys is configured to snap into said one of said openings of said rotatable tuning plate.

8. The portable tuning apparatus of claim 1, further comprising a tension measuring and setting device operably connected to each of said lugs that support said drumhead of said percussion instrument to control and adjust tension imparted to said each of said lugs for said tensioning and said tuning of said drumhead of said percussion instrument.

9. The portable tuning apparatus of claim 1, further comprising a measuring device operably connected to one of said drumhead of said percussion instrument and one or more of said lugs that support said drumhead for measuring tympanic pressure of said drumhead to adjust tension of said drumhead.

10. The portable tuning apparatus of claim 1, further comprising a handle rigidly connected to said rotatable tuning plate for gripping by said user to rotate said rotatable tuning plate.

11. A method for tensioning and tuning a drumhead of a percussion instrument, comprising:

providing a portable tuning apparatus comprising:

a plurality of keys, each of said keys comprising a pair of opposing connector arms separated by a cranked section, wherein said opposing connector arms extend perpendicularly from opposing ends of said cranked section, wherein a first of said opposing connector arms of said each of said keys is configured to engageably rotate a lug of a plurality of lugs that support said drumhead of said percussion instrument, and wherein a second of said opposing connector arms of said each of said keys is configured to slidably engage with one of a plurality of openings on a rotatable tuning plate; and said rotatable tuning plate comprising said openings arranged at predetermined locations on said rotatable tuning plate;

selectively inserting said second of said opposing connector arms of said each of said keys into said one of said openings of said rotatable tuning plate based on diameter of said drumhead of said percussion instrument;

engaging said first of said opposing connector arms of said each of said keys with one of said lugs that support said drumhead of said percussion instrument; and rotating said rotatable tuning plate in one of a clockwise direction and a counterclockwise direction to cause said inserted second of said opposing connector arms along with said cranked section of said each of said keys to orbitally revolve about said first of said opposing connector arms of said each of said keys, wherein said orbital revolution of said second of said opposing connector arms along with said cranked section of said each of said keys causes axial rotation of said first of said opposing connector arms of said each of said keys engaged on said one of said lugs;

whereby said axial rotation of said first of said opposing connector arms of said each of said keys rotates said one of said lugs and imparts a uniform tension to said lugs that support said drumhead of said percussion instrument for said tensioning and said tuning of said drumhead of said percussion instrument.

12. The method of claim 11, wherein said first of said opposing connector arms of said each of said keys of said portable tuning apparatus is substantially parallel to said second of said opposing connector arms of said each of said keys.

13. The method of claim 11, further comprising coaxially aligning said first of said opposing connector arms of said each of said keys with said one of said lugs prior to said engaging of said first of said opposing connector arms of said each of said keys with said one of said lugs.

14. The method of claim 11, wherein said axial rotation of said first of said opposing connector arms of said each of said keys engaged on said one of said lugs uniformly varies tension of said lugs for said tensioning and said tuning of said drumhead of said percussion instrument.

15. The method of claim 11, further comprising controlling and adjusting tension imparted to each of said lugs that support said drumhead of said percussion instrument for said tensioning and said tuning of said drumhead of said percussion instrument by a tension measuring and setting device operably connected to said each of said lugs.

16. The method of claim 11, further comprising measuring tympanic pressure of said drumhead of said percussion instrument to adjust tension of said drumhead by a measuring device operably connected to one of said drumhead and one or more of said lugs that support said drumhead.

17. The method of claim 11, wherein said rotatable tuning plate is rotated in said one of said clockwise direction and said counterclockwise direction using a handle rigidly connected to said rotatable tuning plate.

* * * * *